US011123742B2

(12) United States Patent
Prignon

(10) Patent No.: US 11,123,742 B2
(45) Date of Patent: Sep. 21, 2021

(54) GRINDING ROLLER

(71) Applicant: MAGOTTEAUX INTERNATIONAL S.A., Vaux-sous-Chèvremont (BE)

(72) Inventor: Xavier Prignon, Evelette (BE)

(73) Assignee: MAGOTTEAUX INTERNATIONAL S.A., Vaux-sous Chèvremont (BE)

( * ) Notice: Subject to any disclaimer, the term of this patent is extended or adjusted under 35 U.S.C. 154(b) by 137 days.

(21) Appl. No.: 16/341,375

(22) PCT Filed: Sep. 20, 2017

(86) PCT No.: PCT/EP2017/073701
§ 371 (c)(1),
(2) Date: Apr. 11, 2019

(87) PCT Pub. No.: WO2018/069006
PCT Pub. Date: Apr. 19, 2018

(65) Prior Publication Data

US 2020/0055055 A1 Feb. 20, 2020

(30) Foreign Application Priority Data

Oct. 12, 2016 (EP) ..... 16193517

(51) Int. Cl.
*B02C 15/00* (2006.01)
*B02C 4/30* (2006.01)

(52) U.S. Cl.
CPC ..... *B02C 15/005* (2013.01)

(58) Field of Classification Search
CPC ... B02C 15/005; B02C 15/004; B02C 15/007; B02C 4/30; B02C 4/305
(Continued)

(56) References Cited

U.S. PATENT DOCUMENTS 4,579,289 A * 4/1986 Siebke ..... B02C 15/005 241/110
4,606,506 A * 8/1986 Okada ..... B02C 15/04 241/109
(Continued)

FOREIGN PATENT DOCUMENTS

CN 104549654 A1 4/2015
CN 205020152 U * 2/2016
(Continued)

OTHER PUBLICATIONS

English translate (JP2009183877A), retrieved date Oct. 17, 2020.*
English translate (CN205020152U), retrieved date Feb. 26, 2021.*

*Primary Examiner* — Faye Francis
*Assistant Examiner* — Mohammed S. Alawadi
(74) *Attorney, Agent, or Firm* — Kolitch Romano LLP

(57) ABSTRACT

A grinding roller for vertical axis crushers is disclosed herein that is produced by foundry casting of a metal matrix. The roller includes a plurality of reinforcing inserts on its periphery, wherein some portions of the peripheral surface of a same insert are located at a distance d1 or d2 from the work surface depending on wear stresses. Accordingly, the roller has at least one zone experiencing high wear stress Z1, with at least one portion of the insert positioned at a distance d1 near the work surface of said roller; and a zone with low wear stress Z2, with a portion of the insert positioned at a distance d2 that is set back relative to the work surface of the roller. In some examples, distance d1 is less than distance d2.

20 Claims, 4 Drawing Sheets

(58) Field of Classification Search
USPC ..... 492/1, 3
See application file for complete search history.

(56) References Cited

U.S. PATENT DOCUMENTS

| | | | | | |
|---|---|---|---|---|---|
| 4,848,683 | A * | 7/1989 | Kawatsu | ..... | B02C 2/005 241/294 |
| 5,238,046 | A * | 8/1993 | Guerard | ..... | B02C 4/305 164/110 |
| 6,399,176 | B1 * | 6/2002 | Francois | ..... | B22D 19/06 428/67 |
| 7,438,247 | B2 * | 10/2008 | Leclercq | ..... | B02C 4/305 241/117 |
| 2007/0184235 | A1 * | 8/2007 | Leclercq | ..... | B22D 19/06 428/67 |
| 2017/0043349 | A1 * | 2/2017 | Guerard | ..... | B02C 4/305 |

FOREIGN PATENT DOCUMENTS

| | | | | |
|---|---|---|---|---|
| EP | 1570905 | A1 | | 9/2005 |
| JP | 2009183877 | A | * | 8/2009 |
| JP | 2012035157 | A1 | | 2/2012 |
| WO | 96/05005 | A1 | | 2/1996 |
| WO | 2015015507 | A1 | | 2/2015 |
| WO | 2015162047 | A1 | | 10/2015 |

* cited by examiner

GRINDING ROLLER

FIELD

The present disclosure relates to a grinding roller for vertical axis crushers used to grind materials such as rocks, coal, cement clinker or any other related material such as slag.

BACKGROUND

Grinding rollers for vertical axis crushers are well known by those skilled in the art. They are generally made from relatively ductile cast iron, in which inserts made from extremely wear-resistant material, generally chromium cast irons, sometimes including ceramic grains, are included in order to reinforce the surfaces that are stressed the most during grinding.

EP 1 570 905 A1 discloses a grinding roller comprising several peripheral inserts made from material with high wear resistance and high hardness, mechanically sealed in a cast matrix made from ductile material with first zones subject to high wear stress as well as second zones subject to low wear stress. In the first zone, the roller has, on its peripheral face, inserts comprising an adjoining part, and in the second zone, a non-adjoining part.

WO 9605005 discloses a bimetal foundry part mounted on the hub of a vertical axis crusher roller. It comprises a core made from ductile cast iron provided with mechanical connecting elements in the form of bolts that are joined together by casting an envelope made from a non-ductile wear material with high chromium content.

WO 2015/162047 A1 discloses a grinding roller with inserts with increased massiveness embedded in a metal matrix made from ductile cast iron and steel, the roller comprising inserts with a size modulus V/S comprised between 3 and 5 cm.

AIMS

The present disclosure proposes a roller reinforced by inserts, the profile of which benefits from a particular design, which causes constant wear of the entire work surface of the roller while avoiding local periodic wear. These rollers make it possible to maintain satisfactory performance of the crusher for a longer period of time while minimizing the risks of breakage and decreasing manufacturing costs.

SUMMARY

The present disclosure discloses a grinding roller for vertical axis crushers that is produced by foundry casting of a metal matrix, said roller comprising a plurality of reinforcing inserts on its periphery, whereof some portions of the peripheral surface of a same insert are located at a distance d1 or d2 from the work surface depending on wear stresses, said roller comprising:

- at least one zone experiencing high wear stress Z1, with at least one portion of the insert positioned at a distance d1 near the work surface of said roller;
- a zone with low wear stress Z2, with a portion of the insert positioned at a distance d2 that is set back relative to said work surface of said roller with d1<d2.

According to preferred embodiments of the present disclosure, the roller comprises at least one or an appropriate combination of the following features:

- the roller comprises at least one intermediate zone Z3 connecting the zones Z1 and Z2;
- d1 is less than 10 mm, preferably less than 5 mm and d2 is greater than or equal to 10 mm, preferably greater than 20 mm;
- d1=0;
- the roller comprises two high stress zones Z1 located on either side of a low stress zone Z2 for a roller intended to be used symmetrically;
- the inserts comprise ceramic reinforcements on the face oriented toward the work surface,
- the inserts contain up to 60 vol % of ceramic grains;
- the ceramic grains comprise alumina, zirconia, alumina-zirconia and/or metal carbides;
- the roller is frustoconical.

LIST OF REFERENCE SYMBOLS

Figure 1:
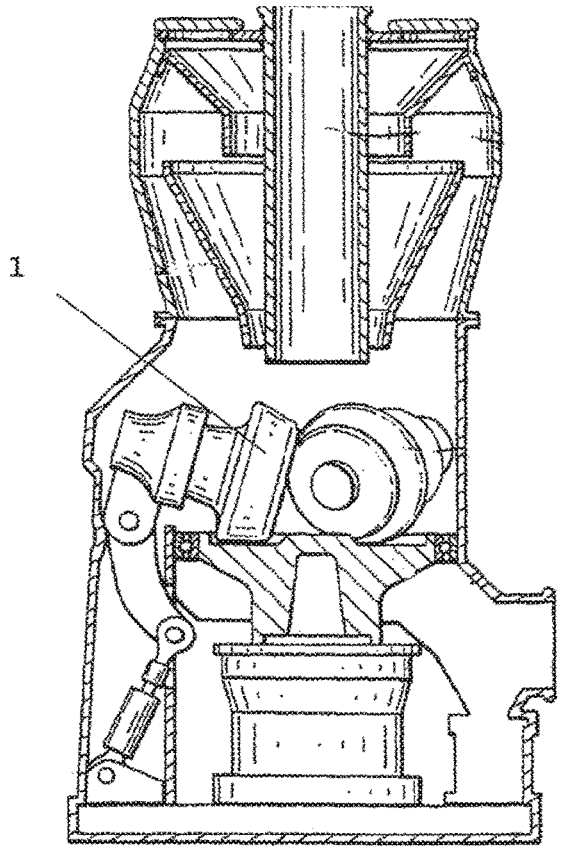
FIG. 1 shows an example vertical axis crusher.

1. Roller
2. Insert
3. Work surface of the roller
Z1: Maximum wear stress zone at the beginning of the use of the roller
Z2: Minimum wear stress zone at the beginning of the use of the roller
Z3: Transition zone between zone Z1 and zone Z2
d1: distance between the original work surface (peripheral surface of the roller in new, unused condition) and the reinforcing insert in zone Z1.
d2: distance between the original work surface (peripheral surface of the roller in new, unused condition) and the reinforcing insert in zone Z2.

DETAILED DESCRIPTION

Vertical axis crushers are known by those skilled in the art. There are different types and they generally comprise a table rotating around a vertical axis on which the material to be ground is supplied. The crusher is equipped with a plurality of very heavy wheels that are generally cylindrical or frustoconical, called "rollers", which are positioned above the table. When the table rotates, the material to be ground is driven toward the outside thereof by the centrifugal force and passes between the rollers and the table.

The inherent weight and a vertical force applied to the rollers create the compacting and grinding of the bed of material passing under the rollers. This material itself serves as frictional link between the table and the rollers, which causes the rotation of the table to cause the rotation of the rollers or vice versa. The grinding in the bed of material is done by compression and shearing of the material.

The compression stresses and the relative speeds between the rollers and the table vary over the width (the thickness) of the roller. The compression stress level depends on the height of the bed of material and the spacing between the rollers and the table over the width of the roller.

The wear of the rollers and the liners of the table is an inevitable consequence of the grinding process. The manufacturers of vertical axis crushers optimize the shapes of the rollers and tables accordingly based on the material to be ground, which makes it possible to obtain an optimal grinding output when the grinding equipment is new.

Given the difference in stresses to which the material and therefore the grinding equipment are subjected, the wear level is not constant over the width of the roller. With time, more pronounced wear zones then form along the generatrix of the rollers, which cause a drop in grinding output and in fine require the replacement of the rollers.

This problem is more pronounced when the optimal bed of material and therefore the distance between the roller and the table is small for given grinding and material conditions, in particular for the materials one wishes to grind at high fineness, such as cement or granulated slag. Under such circumstances, one can already see a drop in output of 10% after local wear of only 20 mm on the roller, and a drop of 40% after wear of about 35 mm.

This drop in output can be explained by the very operation of a vertical axis crusher. The latter comprises a mechanical safety stop preventing the work surface of the grinding roller from coming into contact with the table. In general, this stop is adjusted to provide a safety space of about 10 mm between the table and the work surface of the grinding roller. For effective grinding, in particular of cement and slag, an effort is made to minimize the thickness of the bed of material beyond these 10 mm. If the wear of the roller does not occur uniformly, i.e., parallel to the table of the crusher comprising the bed of material to be ground, but locally, it is impossible to lower the roller toward the table of the crusher and thus to decrease the layer to be ground without touching the mechanical stop. The grinding performance therefore decreases greatly in the local wear locations without being able to act on the thickness of the bed of material to be ground.

In order to minimize this issue, various solutions are currently used by those skilled in the art:

Use of steel rollers that can be recharged by welding. The solution makes it possible to recharge the rollers in the locations experiencing the greatest wear and to reestablish, at least partially, the original profile of the roller. The drawbacks of this solution are the costs and losses of production related to the operations and the downtime to recharge the rollers. Furthermore, the number of possible recharges is limited given that the risk of breakage is increased upon each operation.

Steel rollers with high chromium content embedding ceramic grains are also used in order to increase the lifetime. Rollers with high chromium content are, however, fragile and may break during operation. Furthermore, the issue of localized wear and associated output losses remain unresolved.

EP 1 570 905 A1 discloses a grinding roller comprising several peripheral inserts made from a material with high wear resistance and high hardness, mechanically sealed in a cast matrix made from ductile material with first zones subject to high wear stress as well as second zones subject to low wear stress. In the first zone, the roller has, on its peripheral face, inserts comprising an adjoining part, and in the second zone, a non-adjoining part. This proposition does not yield the expected results, in particular for cement crushers.

Figure 3:
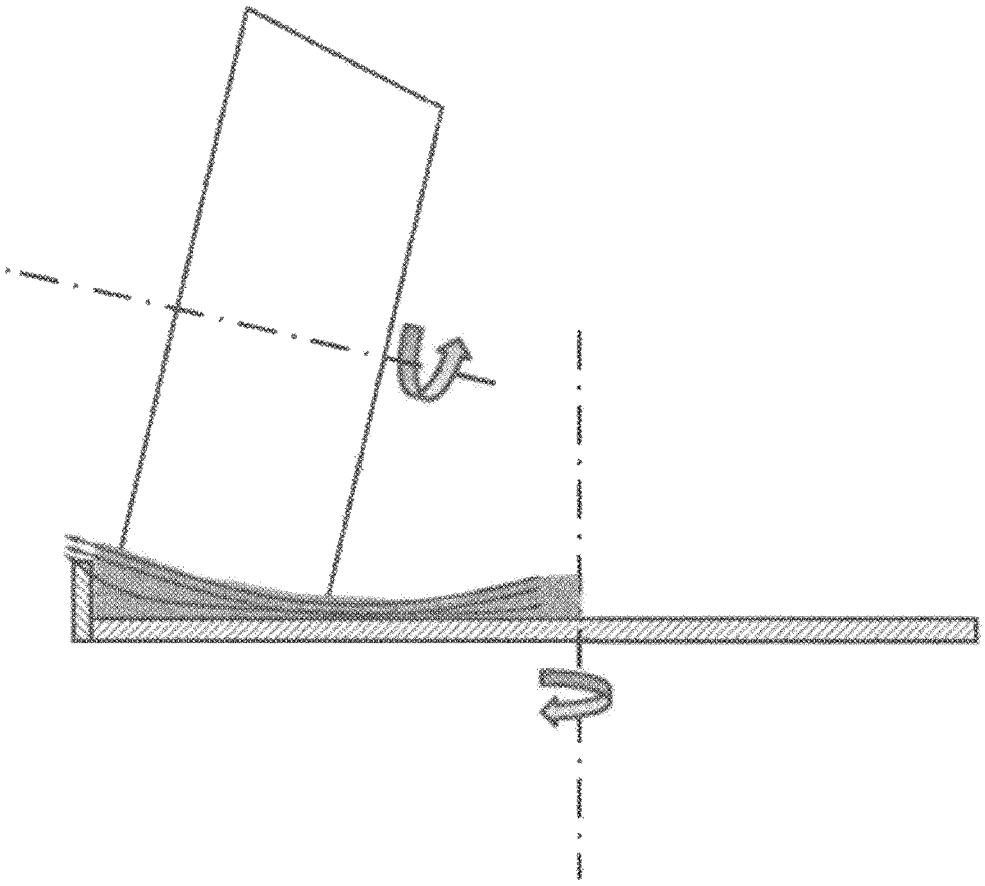
FIG. 3 schematically shows the grinding mechanism in a vertical axis crusher with its rotary table and a layer of material to be ground.

The intensity of wear on a roller of a vertical axis crusher depends primarily on the abrasiveness of the material, the pressure applied locally and the relative speed between the surface of the roller and the material to be ground. While the crusher is rotating, the material accumulates outside the rotary table, which causes much greater wear stress on the outer part of the work surface of the grinding roller (see FIG. 3). This part must therefore be particularly reinforced by inserts.

Figure 2:
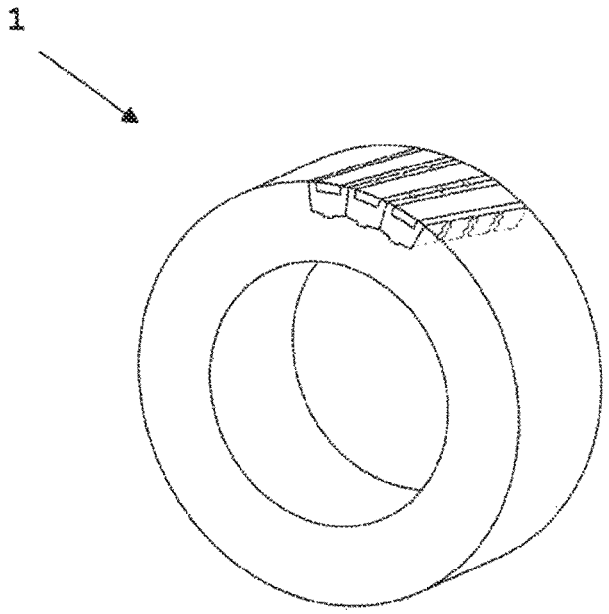
FIG. 2 shows a roller comprising peripheral inserts and ceramic reinforcements included in these inserts on the work surface side according to the state of the art.

The invention discloses grinding rollers, whereof the metal matrix is a relatively ductile material, such as a GS cast iron or a mild steel. These rollers are provided with a plurality of inserts with high wear resistance distributed over the entire periphery near the work surface of the roller (see FIG. 2). These rollers are particularly wear-resistant owing to reinforcing inserts with a specific shape placed near the work surfaces of the roller allowing constant and uniform wear over the entire work surface and thus a longer lifetime.

The originality of the grinding roller according to the present disclosure lies in the design of the inserts, which are profiled such that a part thereof is in the immediate vicinity of, or even flush with, the work surface (in the new condition of the roller) in the locations experiencing high stress, and another part set back from the work surface (in the new condition of the roller) in the zones with less stress. This original distribution of the reinforcement makes it possible to provide more constant wear over the entire width of the work surface of the grinding roller.

In the present application, new condition refers to the condition of the roller with its original profile and therefore not yet used. Of course, distances between the inserts and the work surface of the roller can only be defined in new condition, since these distances can no longer be measured on a roller that has already been greatly worn.

The distance between the portion of the insert near the work surface and the work surface strictly speaking in the zone experiencing high stress (Z1) is defined by d1. The distance between the portion of the insert set back from the work surface and the work surface strictly speaking in the zone experiencing low stress (Z2) is defined by d2, the distance d1 in the zone experiencing high stress (Z1) always being less than d2 in the zone experiencing low stress (Z2). In the prior art, the distance between the outer surface of the insert near the work surface and the work surface strictly speaking in new condition is constant and d1=d2.

When the portion of the outer surface of the insert is flush with the work surface of the grinding roller, d1=0 or is close to zero. The concept of "flush with the work surface" must, however, be put into perspective knowing the dimension of the grinding rollers, the diameter of which is sometimes close to three meters for a weight of 15 tons. The distance d1 is generally less than 10 mm, preferably less than 8 mm, or even 5 mm or less depending on the practical conditions of the casting.

The portion of the outer surface of the insert that is set back from the work surface of the grinding roller is at a distance d2 generally greater than 10 mm, preferably greater than 15 mm and particularly preferably greater than 20 mm.

The inserts will often have a transition zone (Z3) joining the nearby portions and those set back from the work surface. These portions correspond to a zone (Z3) where the outer surface of the insert gradually moves away from the work surface of the roller in new condition. The ductile material filling in the space between the outer surface of the inserts and the original surface of the roller therefore has a variable thickness over the thickness of the roller.

Figure 7:
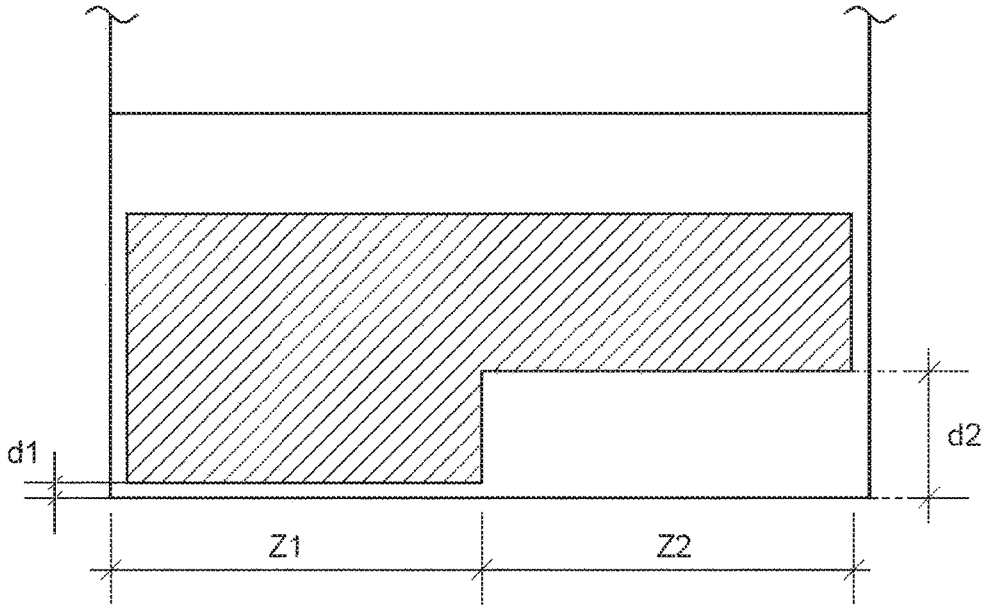
FIG. 7 shows a grinding roller comprising an insert with no transition zone between a zone with high wear stress Z1 and a zone with low wear stress Z2.
Figure 8:
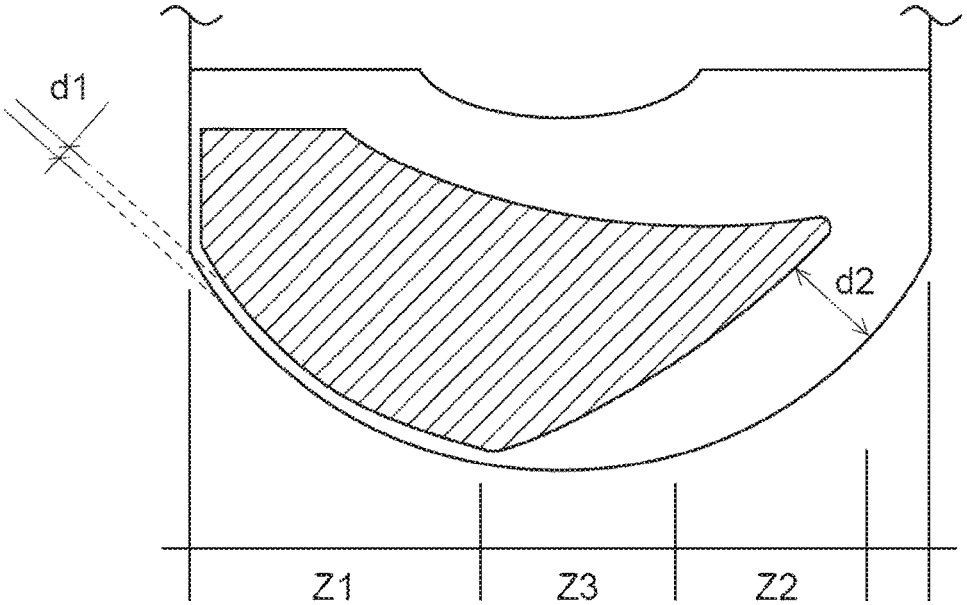
FIG. 8 shows a symmetrical grinding roller of the same type as that shown in FIG. 6, but which is only reinforced on one side and which is therefore intended to be used only on one side.

The presence of a transition zone Z3 is not, however, always necessary and in some cases, the zone experiencing high wear stress Z1 may pass without transition to a zone experiencing low wear stress Z2 (see FIG. 7).

In its simplest version, the roller will therefore comprise, over its work width, two zones, zone 1 (Z1) being subject to high stress where the outer surface of the insert will be closer to or flush with the work surface (original profile) of the roller, zone 2 (Z2) being subject to low stress where the outer surface of the insert will be further from and set back from the work surface (original profile) of the roller (peripheral surface). The rollers will nevertheless often comprise a transitional zone 3 (Z3) corresponding to medium stress intensity where the distances d1 and d2 come together. Within zones Z1 and Z2, the distances d1 and d2 are not necessarily completely constant, but may vary slightly based on difficulties encountered for the placement of the inserts in the molds during the preparation of the casting.

Compared to the solutions of the state of the art, the present disclosure seeks to accelerate the wear in zones 2 and optionally 3, as a result of which the wear gradient between zone 1 and the rest of the thickness of the roller is not as high. The rollers may thus retain a profile closer to the original profile and have therefore a greater lifetime. Based on the thickness of the bed and the type of material, the increased lifetime observed is between 10 and 80%, preferably between 30 and 70%. The most significant improvements were observed on the rollers of the frustoconical type.

Figure 6:
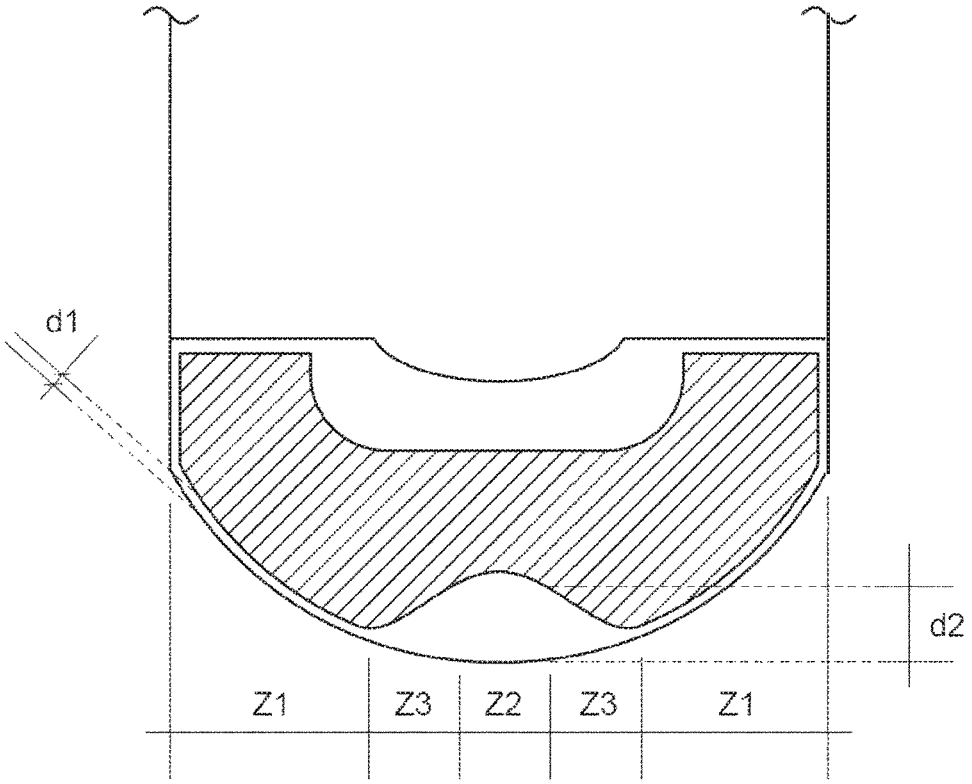
FIG. 6 shows a sectional view of a symmetrical roller with its different stress zones, the distances d1 and d2 showing the non-reinforced thicknesses between the work surface and the insert. Here also, the distance d1 has been exaggerated relative to reality in order to render the graphic depiction clearer.

The grinding rollers that have an axial symmetry with a generatrix of revolution yielding a roller of the "cylinder" or "tire" type (see FIG. 4) are usable on both outer peripheral faces and can be turned over (for example, the rollers for crushers of the RM type). In this scenario, it is possible, according to the present disclosure, to have two zones Z1 and two zones Z2 as well as two transitional zones Z3 as shown in FIG. 6 (tire-shaped roller).

Figure 4:
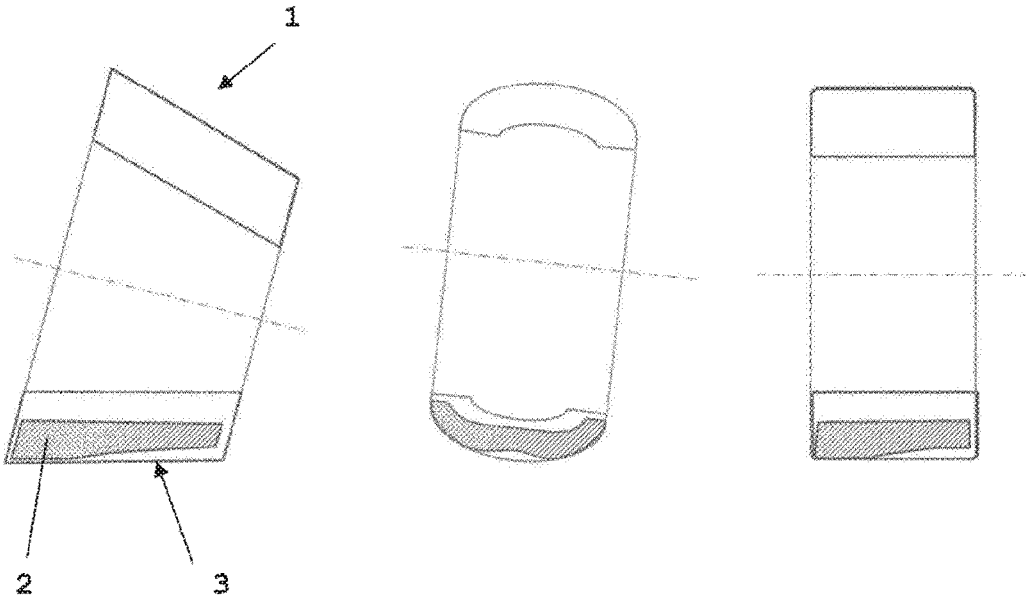
FIG. 4 shows different examples of embodiments of the invention depending on different roller shapes.
Figure 5:
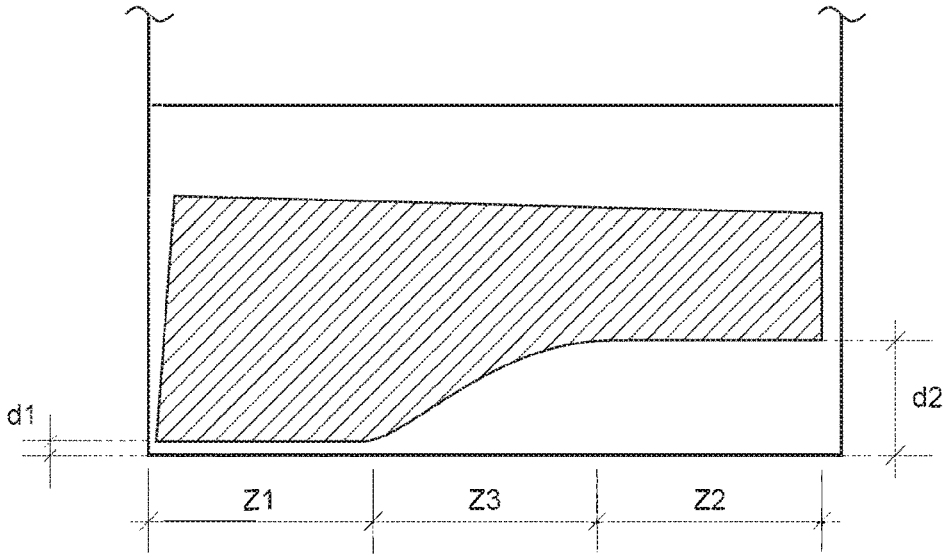
FIG. 5 shows a sectional view of an asymmetrical roller with its different stress zones, the distances d1 and d2 illustrating the non-reinforced thicknesses between the work surface and the insert. In order to render the graphic depiction clearer, the distance d1 has been exaggerated relative to reality.

For the other rollers (nonsymmetrical profile), the most reinforced zones (Z1, d1) must be placed on the outer side of the rotary table of the vertical axis crusher, where the material to be ground accumulates on the periphery and where the pressure on the material to be ground is highest (see FIG. 4).

According to the present disclosure, the inserts may contain ceramic grains (metal oxides, carbides, nitrides or borides, intermetallic compounds) in order to improve the wear resistance thereof. Preferably, these grains will be arranged in the part of the insert that is closest to the (original) peripheral surface of the roller in zone Z1. The arrangement of the ceramic grains is preferably done in the form of a wafer that can be infiltrated by cast iron from the casting. The wafers are preformed with the desired section and placed in the mold before casting.

The advantages of the reinforced rollers according to the present disclosure with respect to the state of the art are:

need for less high-chrome steel (HiCr), since the profile of the insert is now configured according to a "useful" profile to gradually oppose the wear where previously the roller was needlessly reinforced over its entire thickness. The manufacturing costs are thus lower and the roller is more resistant to breaking;

as explained above, the uniform wear of the roller over its entire width also makes it possible to bring the roller closer to the table when one observes the beginning of wear in the inserts, which increases the grinding output.

The following series of paragraphs is presented without limitation to describe additional aspects and features of the disclosure.

A0. A grinding roller (1) for vertical axis crushers produced by foundry casting of a metal matrix, said roller (1) comprising a plurality of reinforcing inserts (2) on its periphery, whereof some portions of the peripheral surface of a same insert are located at a distance d1 or d2 from the work surface (3) based on wear stresses, said roller comprising:

at least one zone experiencing high wear stress Z1, with at least one portion of the insert (2) positioned at a distance d1 near the work surface (3) of said roller;

a zone with low wear stress Z2, with a portion of the insert positioned at a distance d2 set back relative to said work surface (3) of said roller with d1<d2.

A1. The roller (1) according to A0, characterized in that it comprises at least one intermediate zone Z3 connecting the zones Z1 and Z2.

A2. The roller (1) according to any one of paragraphs A0 to A1, characterized in that d1 is less than 10 mm, preferably less than 5 mm and d2 is greater than or equal to 10 mm, preferably greater than 20 mm.

A3. The roller (1) according to any one of paragraphs A0 to A2, characterized in that d1=0.

A4. The roller (1) according to any one of paragraphs A0 to A3, characterized in that it comprises two high stress zones Z1 located on either side of a low stress zone Z2 for a roller intended to be used symmetrically.

A5. The roller (1) according to any one of paragraphs A0 to A4, characterized in that the inserts (2) comprise ceramic reinforcements on the face oriented toward the work surface (3).

A6. The roller (1) according to any one of paragraphs A0 to A5, characterized in that the inserts (2) contain up to 60 vol % of ceramic grains.

A7. The roller (1) according to any one of paragraphs A0 to A6, characterized in that the ceramic grains comprise alumina, zirconia, alumina-zirconia and/or metal carbides.

A8. The roller (1) according to any one of paragraphs A0 to A7, characterized in that said roller is frustoconical.

What is claimed is:

1. A grinding roller for vertical axis crushers produced by foundry casting of a metal matrix, said roller comprising:

a plurality of reinforcing inserts embedded in the grinding roller, such that each of the plurality of reinforcing inserts includes a peripheral surface disposed beneath an original outer surface of the grinding roller, wherein some portions of the peripheral surface of a same one of the plurality of reinforcing inserts are set back from the original outer surface of the roller based on expected wear stresses, such that the roller includes:

at least one first zone configured to experience high wear stress, wherein the first zone has a first portion of the peripheral surface of the same insert set back relative to the original outer surface of the roller by a distance d1; and a second zone configured to experience low wear stress, wherein the second zone has a second portion of the peripheral surface of the same insert set back relative to the original outer surface of the roller by a distance d2;

wherein d1 is less than d2.

2. The roller according to claim 1, wherein the roller comprises at least one intermediate third zone connecting the first and second zones.

3. The roller according to claim 1, wherein d1 is less than 10 mm and d2 is greater than or equal to 10 mm.

4. The roller according to claim 3, wherein d1 is less than 5 mm.

5. The roller according to claim 3, wherein d2 is greater than 20 mm.

6. The roller according to claim 1, wherein d1=0.

7. The roller according to claim 1, wherein the roller comprises two high stress first zones located on either side of the low stress second zone, and the roller is configured to be used symmetrically.

8. The roller according to claim 1, wherein the plurality of reinforcing inserts comprise ceramic reinforcements on a face oriented toward the outer surface.

9. The roller according to claim 1, wherein the plurality of reinforcing inserts contain up to 60 vol % of ceramic grains.

10. The roller according to claim 9, wherein the ceramic grains comprise alumina, zirconia, alumina-zirconia, and/or metal carbides.

11. The roller according to claim 1, wherein the roller is frustoconical.

12. The roller of claim 1, wherein the peripheral surface is a continuous surface.

13. A grinding roller for vertical axis crushers produced by foundry casting of a metal matrix, said roller comprising:

a plurality of reinforcing inserts disposed on a periphery of the grinding roller, each of the plurality of reinforcing inserts including a peripheral surface disposed proximate an original work surface of the grinding roller, wherein some portions of the peripheral surface of a same one of the plurality of reinforcing inserts are located at a distance d1 or d2 from the original work surface of the roller based on expected wear stresses, such that the roller includes:

at least one first zone experiencing high wear stress, wherein the first zone has a first portion of the peripheral surface of the same insert positioned at distance d1 set back relative to the original work surface of the roller; and a second zone experiencing low wear stress, wherein the second zone has a second portion of the peripheral surface of the same insert positioned at distance d2 set back relative to the original work surface of the roller;

wherein d1 is less than d2.

14. The roller according to claim 13, wherein the roller comprises at least one intermediate third zone connecting the first and second zones.

15. The roller according to claim 13, wherein d1 is less than 10 mm and d2 is greater than or equal to 10 mm.

16. The roller according to claim 13, wherein the roller comprises two high stress first zones located on either side of the low stress second zone, and the roller is configured to be used symmetrically.

17. The roller according to claim 13, wherein the plurality of reinforcing inserts comprise ceramic reinforcements on a face oriented toward the work surface.

18. The roller according to claim 13, wherein the plurality of reinforcing inserts contain up to 60 vol % of ceramic grains, the ceramic grains comprising alumina, zirconia, alumina-zirconia, and/or metal carbides.

19. The roller according to claim 13, wherein the roller is frustoconical.

20. The roller of claim 13, wherein the peripheral surface is a continuous surface.

* * * * *